United States Patent [19]

Wilhelm et al.

[11] Patent Number: 4,934,146

[45] Date of Patent: Jun. 19, 1990

[54] PROCESS FOR H2S AND HC REMOVAL FROM NATURAL GAS

[75] Inventors: Joachim Wilhelm, Schwalbach; Ulf Jauernik; Manfred Kriebel, both of Frankfurt am Main, Fed. Rep. of Germany

[73] Assignee: Metallgesellschaft Aktiengesellschaft, Frankfurt am Main, Fed. Rep. of Germany

[21] Appl. No.: 402,841

[22] Filed: Sep. 1, 1989

[30] Foreign Application Priority Data

Sep. 2, 1988 [DE] Fed. Rep. of Germany ..... 3829878

[51] Int. Cl.[5] ..... F25J 3/00

[52] U.S. Cl. ..... 62/17; 55/68; 62/20

[58] Field of Search ..... 62/17, 20; 55/68

[56] References Cited

U.S. PATENT DOCUMENTS

| | | | |
|---|---|---|---|
| 3,373,574 | 3/1968 | Fisher | 62/20 |
| 3,654,769 | 4/1972 | Linde | 62/20 |
| 4,038,332 | 7/1977 | Carter | 62/20 |
| 4,336,045 | 6/1982 | Fisher et al. | 62/20 |
| 4,488,890 | 12/1984 | Foerg et al. | 55/68 |
| 4,654,062 | 3/1987 | Gottier et al. | 62/17 |
| 4,710,210 | 12/1987 | Gazzi et al. | 62/68 |
| 4,711,211 | 12/1987 | Gazzi et al. | 62/20 |

*Primary Examiner*—Ronald C. Capossela
*Attorney, Agent, or Firm*—Herbert Dubno

[57] ABSTRACT

A natural gas, which in addition to methane contains 2 to 4 carbon atoms per molecule and $H_2S$, is treated to remove the $H_2S$ and the hydrocarbons in part. The natural gas under a pressure of at least 5 bars is indirectly cooled in a heat exchange zone to temperatures from −30° to 100° C. The condensate is removed from the cooled natural gas and is pressure-relieved and is then passed as a coolant through the heat exchange zone. Scrubbing liquor is cooled in the heat exchange zone to temperatures from −30° to −80° C. and is contacted in a scrubbing zone with the natural gas from which the condensate has been removed. The laden scrubbing liquor which has been withdrawn from the scrubbing zone is passed through the heat exchange zone. The natural gas which has been purified in the scrubbing zone is pressure-relieved and is also passed through the heat exchange zone.

8 Claims, 1 Drawing Sheet

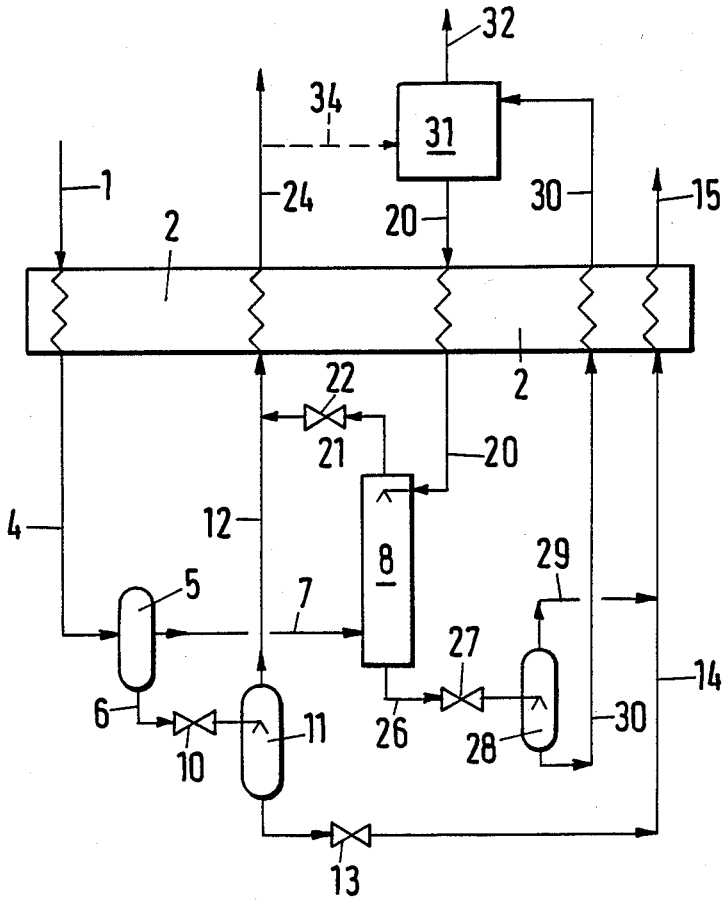
32
34
31
1
24
30
15
2
20
2
22
21
20
4
12
8
29
5
7
27
14
6
11
26
28
30
10
13

PROCESS FOR H2S AND HC REMOVAL FROM NATURAL GAS

FIELD OF THE INVENTION

Our present invention relates to a process of treating natural gas, which in addition to methane contains hydrocarbons having 2 to 4 carbon atoms per molecule and also contains $H_2S$, in order to remove part of the hydrocarbons and of the $H_2S$.

BACKGROUND OF THE INVENTION

From crude natural gas to be used, e.g. as a feedstock for a catalytic steam reforming process, the hydrocarbons having 5 and more carbon atoms per molecule can relatively easily be removed by adsorption. But in a catalytic reforming process, the hydrocarbons, particularly the higher hydrocarbons, form coke deposits on the catalyst so that its activity is decreased.

OBJECT OF THE INVENTION

It is an object of the present process to remove the $C_2$–$C_4$ hydrocarbons, which can be separated by prior-art methods only with great difficulty, and to remove as well the $H_2S$, which is also detrimental to the reforming catalyst, to an adequate degree and in an economical manner.

SUMMARY OF THE INVENTION

This object is achieved, in accordance with the invention, in that the natural gas under a pressure of at least 5 bars is indirectly cooled in a heat exchange zone to temperatures from −30° to −100° C., condensate is separated and is pressure-relieved and is passed as a coolant through the heat exchange zone, a scrubbing liquor coming from a regenerating zone is cooled in the heat exchange zone to temperatures from −30° to −80° C. and is then fed to a scrubbing zone, which is also fed with the natural gas from which the condensate has been removed, scrubbing liquor which is laden with $H_2S$ and hydrocarbons is passed from the scrubbing zone through the heat exchange zone to the regenerating zone, and the natural gas which has been purified in the scrubbing zone is pressure-relieved and passed through the heat exchange zone.

More particularly, the method comprises the steps of:

(a) feeding the natural gas which, in addition to methane, contains $C_2$ to $C_4$ hydrocarbons and $H_2S$, at a pressure of at least 5 bars to a heat exchange zone and indirectly cooling the natural gas fed to the heat exchange zone to a temperature of substantially −30° C. to −100° C.;

(b) separating condensate from the natural gas indirectly cooled in the heat exchange zone in step (a) and pressure-relieving the separated condensate to form a coolant;

(c) passing the coolant through the heat exchange zone to indirectly cool the heat exchange zone therewith;

(d) cooling a scrubbing liquid coming from a regenerating zone to a temperature of substantially −30° C. to −80° C. by passing the scrubbing liquid through the heat exchange zone;

(e) feeding scrubbing liquid cooled in the heat exchange zone in step (d) from the heat exchange zone into a scrubbing zone and scrubbing therewith in the scrubbing zone, natural gas from which the condensate has been separated in step (b), thereby forming a scrubbing liquid laden with the hydrocarbons and $H_2S$;

(f) feeding the scrubbing liquid laden with the hydrocarbons and $H_2S$ to the regenerating zone and removing hydrocarbons and $H_2S$ therefrom to form the scrubbing liquid which is cooled in step (d); and (g) pressure-relieving natural gas which has been scrubbed in the scrubbing zone in step (e) and passing the pressure-relieved natural gas through the heat exchange zone as a coolant therefor.

As the hydrocarbons are condensed out, a substantial part of the $H_2S$ is advantageously condensed out too so that the load on the succeeding scrubbing zone is decreased. That scrubbing zone is so designed that the $H_2S$ is sufficiently removed from the natural gas in that zone. $C_3$ and $C_4$ hydrocarbons are usually also removed from the natural gas in the scrubbing zone so that the preceding condensation may be effected at a lower rate.

The refrigeration which is required for the process is provided by the condensate which is pressure-relieved, and by the natural gas coming from the scrubbing zone which is also pressure-relieved.

There is usually no need for a separate refrigerating system. Because the refrigeration required in the scrubbing zone is not high, since the scrubbing liquor is required only at a low rate, the refrigeration effected by the condensation will also be sufficient for an adequate cooling of the scrubbing liquor before the scrubbing zone.

In a highly advantageous embodiment, the condensate which has been removed from the cooled natural gas is pressure-relieved in two stages and the flashed-off gas thus obtained is passed through the heat exchange zone.

Methanol or acetone or other $C_1$–$C_3$-oxohydrocarbons can be used as a scrubbing liquor.

BRIEF DESCRIPTION OF THE DRAWING

The above and other objects, features and advantages of our invention will become more readily apparent from the following description, reference being made to the accompanying highly diagrammatic drawing the sole FIGURE of which is a flow diagram illustrating the invention.

SPECIFIC DESCRIPTION

Natural gas which contains hydrocarbons and $H_2S$ is supplied in line 1 at a pressure of at least 5 bar and preferable at least 10 bar.

The solids and the hydrocarbons having 5 and more carbon atoms per molecule have advantageously been removed from that natural gas in a prior step.

As a result, the natural gas in line 1, primarily constituted of $CH_4$, contains, in addition to $H_2S$, mainly $C_2$-, $C_3$- and $C_4$-hydrocarbons.

In a heat exchange zone 2 consisting, e.g. of a plate-type heat exchanger, that natural gas is indirectly cooled to temperatures of −30° to −100° C., preferably −40° to −90° C.

That cooling results in a formation of condensate, which contains a major part of the hydrocarbons and a considerable part of the $H_2S$. That mixture is fed in line 4 to a separator 5, from which the condensate is withdrawn in line 6. The mixed gases are supplied in line 7 to a scrubbing column 8.

The condensate is partly pressure-relieved through the expansion valve 10 and is supplied to a separating vessel 11. The flashed-off gas is withdrawn in line 12 and the condensate is pressure-relieved once more through the expansion valve 13. The expansion of the condensate in valve 10 and 13 results in a considerable pressure drop. Therefore the condensate which is passed in line 14 through the heat exchange zone 2 may effectively serve as a coolant.

The exhaust gas formed as a result of the temperature rise in the heat exchange zone 2 is available in line 15 and because it has a high heating value can be used as a fuel gas.

The scrubbing column 8 is supplied via line 20 with a scrubbing liquor at temperatures from −30° to −80° C. and preferably from −60° to −70° C.

In the following description it is assumed that the scrubbing liquor consists of methanol although other scrubbing liquors may also be used.

The column 8 usually contains plates or packing elements and is used to sufficiently scrub $H_2S$ from the natural gas which is supplied in line 7 and hydrocarbons are also taken up by the methanol. Purified natural gas is withdrawn in line 21 and is at least partly pressure-relieved in the expansion valve 22 to reduce its temperature.

The natural gas and the gas in line 12 are then jointly passed through the heat exchange zone 2, where the mixed gases are used as a coolant, and are available-in line 24 as a product for further use.

The scrubbing liquor which is laden with $H_2S$ and hydrocarbons is withdrawn in line 26 from the column 8 and is pressure-relieved in the expansion valve 27, and the mixture is fed to a separating vessel 28.

$H_2S$-Containing exhaust gas is added through line 29 to the condensate in line 14. The scrubbing liquor is passed in line 30 through the heat exchange zone 2 and is then fed to a regenerating system 31. In the system 31, hydrocarbons and $H_2S$ loading the scrubbing liquor are substantially removed therefrom in a manner known per se by stripping or heating or by a combination of these operations.

An exhaust gas is withdrawn in line 32 and is passed to means, not shown, for a further processing.

Regenerated scrubbing liquor is withdrawn in line 20 and is recycled to the scrubbing column 8 by a pump, not shown. For instance, a partial stream of the product gas in line 24 may be used for the regeneration in the system 31 and may be supplied through the line 34, which is indicated by a broken line, and used as a stripping gas.

The product gas in line 24 consists mainly of methane and may also contain 2 to 20% by volume $C_2$-hydrocarbons. The content of $C_3$-hydrocarbons lies in most cases below 0.1% by volume and the $H_2S$ content is not in excess of about 1/10 of the $H_2S$ content in the gas in line 1. Owing to that purity, the product gas can well be used as a feedstock for the catalytic steam reforming to produce a mixed gas consisting of CO and $H_2$.

SPECIFIC EXAMPLE

In a processing system like that shown in the drawing, 50,000 sm (sm=standard cubic meter) of natural gas were treated per hour. Some parameters of the process are a result of calculation. In a preceding stage, hydrocarbons having 5 and more carbon atoms and impurities were removed. The natural gas in line 1 has the following composition:

| | |
|---|---|
| $CH_4$ | 75% by volume |
| $C_2H_6$ | 20% by volume |
| $C_3H_8$ | 1% by volume |
| $N_2$ | 3% by volume |
| $CO_2$ | 1% by volume |

The natural gas contains also 400 volume ppm $H_2S$ and is under a pressure of 28 bars and at a temperature of 30° C. It is cooled to −73° C. in a plate-type heat exchanger and then enters the separator 5. The condensate which has been separated is pressure-relieved to 10 bars, in the expansion valve 10 and is pressure-relieved further to 2 bars in the valve 13.

The gas which is fed in line 7 to the scrubbing column 8 still contains about one-half of the originally contained $C_2$-hydrocarbons and of the $H_2S$ and also contains $N_2$ and $CO_2$ and traces of $C_3$-hydrocarbons.

Methanol at −70° C. is supplied as a scrubbing liquor to the column 8 at a rate of 10 m/h. A pressure of 28 bars is maintained in the scrubbing column.

The scrubbed gas is virtually free of $H_2S$ and of $C_3$-hydrocarbons and contains only a small amount of residual $C_2$-hydrocarbons and is passed through the expansion valve 22 to reduce the pressure to 10 bars.

A treated natural gas consisting of a mixture of the scrubbed gas and of the gas passed through line 12 is obtained in line 24 at a rate of 43,000 sm, under a pressure of 10 bars and at a temperature of 22° C. and in addition to $CH_4$ contains 10% by volume $C_2$-hydrocarbons, 0.1% by volume $C_3$-hydrocarbons, 3.4% by volume $N_2$. 0.7% by volume $CO_2$ and 5 volume ppm. $H_2S$.

The laden scrubbing liquor which has been withdrawn from the scrubbing column in line 26 is pressure-relieved to 2 bars. The flashed-off gas is admixed to the gas in line 14 so that an exhaust gas under a pressure of 2 bars and a temperature of +10° C. is obtained in line 15 at a rate of 7,000 sm/h. The methanol is fed in line 30 to the regenerating system 31, where the lading is substantially removed from the methanol as it is stripped with natural gas from line 34 at temperatures of +10° C. The methanol is then recycled to the scrubbing column 8 by a pump, not shown.

We claim:

1. A process for treating natural gas which, in addition to methane, contains $C_2$ to $C_4$ hydrocarbons and $H_2S$ to remove part of said hydrocarbons and said $H_2S$, said process comprising the steps of:

(a) feeding said natural gas which, in addition to methane, contains $C_2$ to $C_4$ hydrocarbons and $H_2S$, at a pressure of at least 5 bars to a heat exchange zone and indirectly cooling the natural gas fed to said heat exchange zone to a temperature of substantially −30° C. to −100° C.;

(b) separating condensate from the natural gas indirectly cooled in said heat exchange zone in step (a) and pressure-relieving the separated condensate to form a coolant;

(c) passing said coolant through said heat exchange zone to indirectly cool said heat exchange zone therewith;

(d) cooling a scrubbing liquid coming from a regenerating zone to a temperature of substantially −30° C. to −80° C. by passing the scrubbing liquid through said heat exchange zone;

(e) feeding scrubbing liquid cooled in said heat exchange zone in step (d) from said heat exchange zone into a scrubbing zone and scrubbing therewith in said scrubbing zone, natural gas from which said condensate has been separated in step (b), thereby forming a scrubbing liquid laden with said hydrocarbons and $H_2S$;

(f) feeding said scrubbing liquid laden with said hydrocarbons and $H_2S$ to said regenerating zone and removing hydrocarbons and $H_2S$ therefrom to form the scrubbing liquid which is cooled in step (d); and (g) pressure-relieving natural gas which has been scrubbed in said scrubbing zone in step (e) and passing the pressure-relieved natural gas through said heat exchange zone as a coolant therefor.

2. The process defined in claim 1 wherein said natural gas is pressurized to at least 10 bars before it is fed to said heat exchange zone in step (a).

3. The process defined in claim 1 wherein said condensate is pressure-relieved in step (b) in two stages to obtain a flashed-off gas which is passed through said heat exchange zone as the coolant of step (b).

4. The process defined in claim 1 wherein said scrubbing liquid laden with said hydrocarbons and $H_2S$ from step (f) is partly pressure-relieved to produce an $H_2S$-containing flashed-off gas, said process further comprising the step of:

(h) passing said $H_2S$-containing flashed-off gas through said heat exchange zone.

5. The process defined in claim 1 wherein said scrubbing liquid is formed by methanol, acetone or another $C_1$ to $C_3$ oxohydrocarbon or a mixture thereof.

6. The process defined in claim 5 wherein said scrubbing liquid laden with said hydrocarbons and $H_2S$ from step (f) is partly pressure-relieved to produce an $H_2S$-containing flashed-off gas, said process further comprising the step of:

(h) passing said $H_2S$-containing flashed-off gas through said heat exchange zone.

7. The process defined in claim 6 wherein said condensate is pressure-relieved in step (b) in two stages to obtain a flashed-off gas which is passed through said heat exchange zone as the coolant of step (b).

8. The process defined in claim 7 wherein said natural gas is pressurized to at least 10 bars before it is fed to said heat exchange zone in step (a).

* * * * *